US005215389A

United States Patent [19]

Kato et al.

[11] Patent Number: 5,215,389

[45] Date of Patent: Jun. 1, 1993

[54] PRINT HEAD FOR A DOT MATRIX PRINTER

[75] Inventors: Yukihisa Kato; Tetsuya Yamamoto; Makoto Yasunaga, all of Tanashi, Japan

[73] Assignee: Citizen Watch Co., Ltd., Tokyo, Japan

[21] Appl. No.: 924,586

[22] Filed: Aug. 6, 1992

Related U.S. Application Data

[63] Continuation of Ser. No. 662,023, Feb. 28, 1991, abandoned.

[30] Foreign Application Priority Data

Feb. 28, 1990 [JP] Japan ..... 2-18797[U]
Mar. 5, 1990 [JP] Japan ..... 2-21501[U]

[51] Int. Cl.[5] ..... B41J 2/25
[52] U.S. Cl. ..... 400/124; 101/93.05
[58] Field of Search ..... 400/124; 101/93.05

[56] References Cited

U.S. PATENT DOCUMENTS 4,569,605 2/1986 Meier et al. ..... 400/124
4,723,854 2/1988 Sakaida et al. ..... 400/124
4,828,409 5/1989 Sparshott et al. ..... 400/124
4,962,876 10/1990 Andou et al. ..... 400/124
4,979,836 12/1990 Stempfle ..... 400/124
4,988,223 1/1991 Hilkenmeier et al. ..... 400/124
5,009,529 4/1991 Gugel et al. ..... 400/124

FOREIGN PATENT DOCUMENTS 202872 11/1984 Japan ..... 400/124
212362 10/1985 Japan ..... 400/124
49851 3/1986 Japan ..... 400/124
81056 4/1988 Japan ..... 400/124

*Primary Examiner*—Edgar S. Burr
*Assistant Examiner*—Anthony H. Nguyen

[57] ABSTRACT

A print head for a dot matrix printer has a head body, a plurality of print needles slidably mounted in the head body, a plurality of armatures, each corresponding to the print needle, an electromagnet provided on the head body for attracting a corresponding armature for actuating the print needles. The guide grooves are formed in the head body, corresponding to the armatures. An end portion of the armature is inserted in the guide groove so as to be guided during printing operation.

4 Claims, 2 Drawing Sheets

PRINT HEAD FOR A DOT MATRIX PRINTER

This application is a continuation of application Ser. No. 07/662,023 filed on Feb. 28, 1991, now abandoned.

BACKGROUND OF THE INVENTION

The present invention relates to a print head for a dot matrix printer of an armature attracting type in which an electromagnet attracts an armature to move a print needle for printing operation.

U.S. Pat. No. 4,647,236 discloses a print head of an armature attractive type which comprises a plurality of print needles slidably mounted in a head body, a plurality of armatures, and a plurality of electromagnets. Each electromagnet has a core formed on a yoke which is secured to the head body and a magnetizing coil. The attracting surface of the core is located lower than the end of the bobbin of the coil to form a recess in the bobbin. The armature has a plunger inserted into the recess of the magnet. A base end of the armature is abutted on a fulcrum surface of the yoke by an armature spring. Thus, the armature is attracted by the magnet to be pivoted about the fulcrum surface.

The armature is slidably mounted in a guide groove formed in an armature based so as not to deviate during printing operation.

In another prior art, the armature is slidably mounted in a guide groove formed in the yoke secured to the head body.

However, it may occur that the armature deflects from the axis of the print needle, which is caused, for example, by error in position between the armature base or the yoke and the armature. If the armature deflects from the center of the print needle, the armature may engage two print needles, causing double printings. Since the contact area between the armature and the head of the needle reduces, contact pressure per unit area increases. As a result, the wear of the needle increases, causing the life of the needle to shorten.

In the print head of U.S. Pat. No. 5,009,529, a needle is guided by a guide bush, and an armature is guided by cams formed on a shell. Namely, the armature is guided by a member different from a guide member of the needle. Therefore, the position of the armature is liable to be deflected from the needle.

On the other hand, it is difficult to assemble the print head in which the guide groove is provided in the armature base, as described hereinafter. The armatures are mounted on the armature base. Needles and the yoke having the core on which the coils are attached are mounted on the head body. Both the armature base and head body are opposed and coupled with each other. At that time, either of the armature base and the head body must be inverted. If the armature base is inverted, armatures may fall. If the head body is inverted, needles can fall. Therefore, the print head is manually assembled by a skilled person, because it is difficult to automate the assembling of the print head.

SUMMARY OF THE INVENTION

An object of the present invention is to provide a print head in which an actuating end of an armature is positioned with accuracy.

Another object of the present invention is to provide a print head which may be automatically assembled.

According to the present invention, there is provided a print head for a dot matrix printer having a head body, a plurality of print needles slidably mounted in the head body, a plurality of armatures, each corresponding to the print needle, an electromagnetic provided on the head body for attracting a corresponding armature for actuating the print needles. Guide grooves are formed in the head body, corresponding to the armatures, an end portion of the armature is inserted in the guide grooves so as to be guided during printing operation.

In an aspect of the invention, the guide grooves are formed in a guide projection formed in the head body.

In another aspect, the armature has a needle actuating face engaged with the print needle, a plunger attracted by the electromagnet, and a fulcrum surface.

The needle actuating face, a top surface of the plunger and the fulcrum surface are flush with each other.

These and other objects and features of the present invention will become more apparent from the following detailed description with reference to the accompanying drawings which are given by way of illustration only, and thus are not limitative of the present invention.

DETAILED DESCRIPTION OF THE PREFERRED EMBODIMENT

Figure 1:
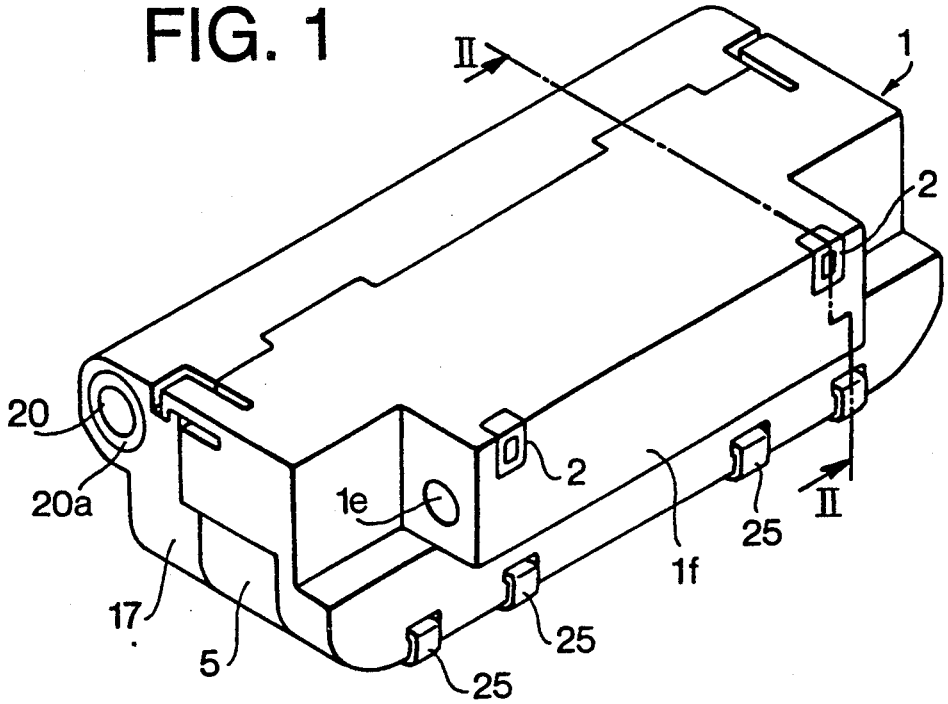
FIG. 1 is a perspective view showing a print head for a dot matrix printer according to the present invention.
Figure 3:
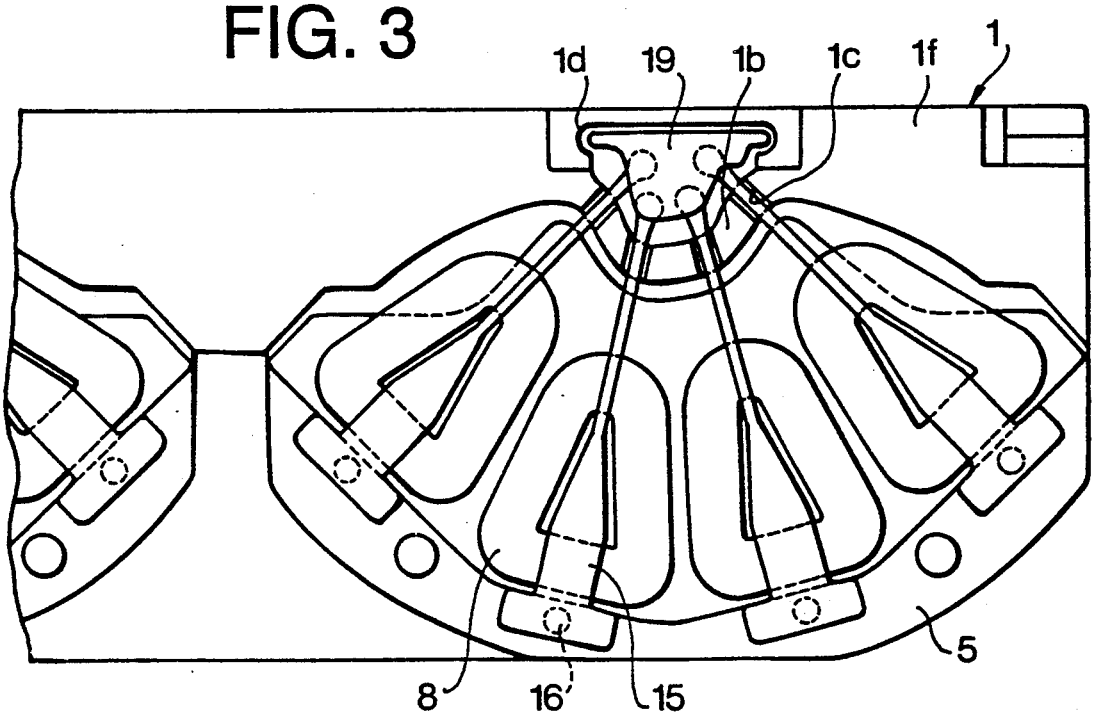
FIG. 3 is a sectional view taken along a line III—III of FIG. 2.
Figure 2:
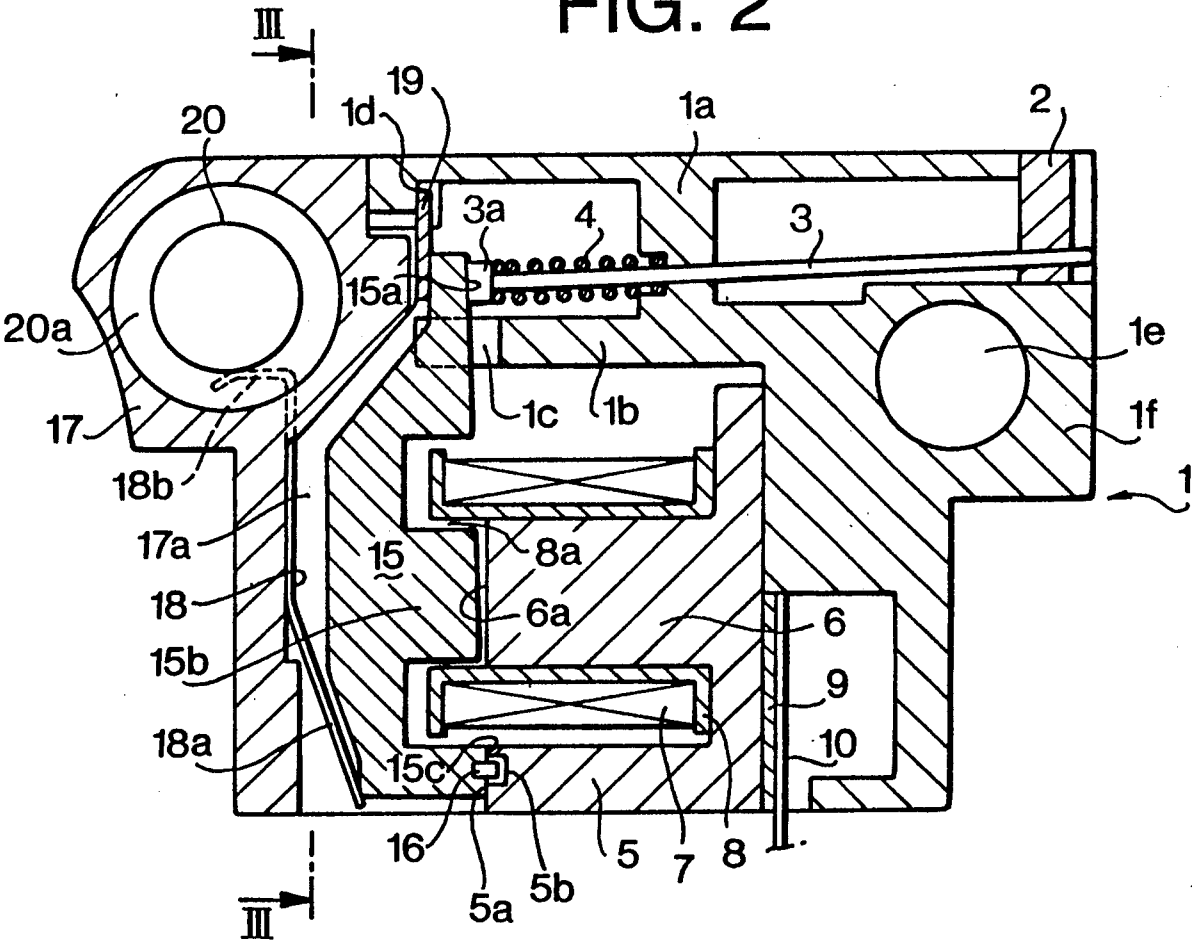
FIG. 2 is a sectional side view taken along a line II—II of FIG. 1.

Referring to the drawings, a print head comprises a head body 1 made of plastic and an armature base 17. In the head body, a pair of print units are provided for serially performing printing characters on a line. Hereinafter, one of the print units is described, because both units are the same in structure and operation.

The head body 1 has a nose 1*f* in which a front guide member 2 is secured and a rear guide member 1*a* is integrally formed. In the guide member 2 and 1*a*, four needles 3 are slidably mounted. Each needle 3 has a head 3*a* at the rear end and is rearwardly urged by a spring 4 provided between the rear guide member 1*a* and the head 3*a*. A yoke 5 of magnetic material is secured to the head body 1. On the yoke 5, four cores 6 are formed, corresponding to the needles 3. The yoke 5 has a fulcrum surface 5*a* and a positioning hole 5*b* formed in the fulcrum surface 5*a*. An attracting surface 6*a* of the core 6 is located at the same height as the fulcrum surface 5*a*. On each core 6, a coil bobbin 8 having a coil 7 is mounted to form an electromagnet. The top end of the bobbin 8 is located higher than the attracting surface 6*a* of the core to form a recess 8*a* in the bobbin. A flexible print cable 10 is attached on the opposite side of the core 6 through an insulator 9. The coil bobbin 8, insulator 9 and flexible print cable 10 are secured to the yoke 5.

An armature 15 is mounted on the fulcrum surface 5*a* and the head 3*a* of the needle 3, corresponding to each needle. The armature 15 has a needle actuating face 15*a* abutted on the head 3*a*, a plunger 15*b* inserted into the recess 8*a* and a fulcrum end 15*c* engaged with the fulcrum surface 5*a*. The needle actuating face 15*a*, the top face of the plunger 15*b* and fulcrum end 15*c* are formed on the same plane. A positioning pin 16 is secured to an end portion of the armature 15 so as to be inserted in the positioning hole 5*b*.

A guide member projection 1*b* is formed on the head body 1 near the actuating face 15*a* of the armature 15. Four guide grooves 1*c* are formed in the guide projection, corresponding to the armatures. An end portion of each armature 15 is slidably engaged in the guide groove 1*c* so as to be guided.

A back stopper 19 is provided on a positioning shoulder 1*d* formed on the head body 1 adjacent the back side of armature 15 opposite to the actuating face 15*a*.

The armature base 17 has a recess 17*a* enclosing armature 15. An armature spring 18 is mounted on the bottom of the recess 17*a*. The armature spring 18 has four branches 18*a* each of which is abutted on the back of the end of the corresponding armature 15 to urge the fulcrum end 15*c* to the fulcrum surface 5*a*.

A guide hole 1*e* is formed in the head body 1 and another guide hole 20 provided in a bush 20*a* secured in a hole formed in the armature base 17. Both holes 1*e* and 20 are slidably engaged with a pair of guide bars of a printer which are provided in parallel with a platen, so that the print head is slidably mounted on the guide bars. A part 18*b* of the armature spring 18 is in contact with the guide bar, thereby grounding the armature 15 to discharge static electricity generated in the print paper.

An assembling manner of the print head is describe hereinafter.

The needles 3 are attached to the head body 1 together with the needle spring 4. The coil bobbins 8 each having the coil 7, the insulator 9 and the flexible print cable 10 are mounted on the yoke 5. The head body 1 is held in an upward position of the head 3*a* of the print needle 3. The assembled yoke 5 is mounted on the head body 1. The armature 15 is mounted on the yoke 5, inserting the end portion thereof in the guide groove 1*c*, and inserting the positioning pin 16 in the positioning hole 5*b*. The back stopper 19 is mounted on the armature, positioned by the positioning shoulder 1*d*. The armature spring 18 is attached to the armature base 17, and the armature base is mounted on the head body 1 and the yoke 5. Finally, the head body 1, yoke 5 and armature base 17 are clamped together by clamps 25 as shown in FIG. 1.

In accordance with the present invention, the guide groove 1*c* is provided in the head body 1 for positioning the actuating face 15*a* of the armature 15. The end portion of the armature is guided by the guide grooves formed in the head body, and the corresponding needle is also guided in the head body. In other words, the armature is guided in the same member as that of the needle. Consequently, the armature can be accurately positioned corresponding to the needle when assembled. In addition, assembled yoke, armatures 15 and armature base 17 are assembled with the head body by superimposing thereon in order. Therefore, the print head can be assembled with an automatic machine.

On the other hand, the needle actuating face 15*a*, the top face of the plunger 15*b* and the fulcrum end 15*c* are flush with each other. Therefore, the finishing machining with a milling cutter and a grinding wheel can be easily performed with accuracy.

While the invention has been described in conjunction with preferred specific embodiment thereof, it will be understood that this description is intended to illustrate and not limit the scope of the invention, which is defined by the following claims.

What is claimed is:

1. A print head for a dot matrix printer having a head body having a nose, a plurality of print needles axially slidably mounted in the head body, each of the print needles having a head at a rear end thereof, a plurality of armatures, an armature base secured to the head body for covering the armatures, an armature spring disposed between one of the armatures and the armature base, an electromagnet provided on the head body for attracting a corresponding armature for actuating the print needles, comprising:

the electromagnet having a coil bobbin and a core, said core having an attracting surface at a position lower than the top end of the bobbin so as to form a recess in the bobbin;

each of the armatures having a needle actuating face corresponding to the head of the print needle, a projecting plunger having a top face inserted into the recess of the coil bobbin and a fulcrum end;

the needle actuating face, the top face of the plunger and the fulcrum end all being formed in the same plane;

each armature being abutted at the fulcrum end by the armature spring;

a guide member integrally formed in the nose at a rear portion of the nose and having a hole for supporting the print needle;

each of the print needles being slidably mounted in the hole of the guide member at a portion adjacent to the head of the print needle;

a needle spring provided between the head of the print needle and the guide member so as to maintain the abutment between the head and the needle actuating face;

the head body having guide grooves adjacent to the guide member corresponding to the armatures;

an end portion of the armature adjacent the needle actuating face being slidably inserted in the guide groove so as to be guided during the printing operation.

2. The print head according to claim 1, wherein the guide grooves are formed in a guide projection formed in the head body.

3. The print head according to claim 1, wherein the attracting surface of the core and the fulcrum surface are formed at the same height.

4. The print head according to claim 3, including a yoke secured to the head body, the core being formed on said yoke, and the fulcrum surface being formed on the yoke.

* * * * *